US009075358B2

(12) United States Patent
Kaji et al.

(10) Patent No.: US 9,075,358 B2
(45) Date of Patent: Jul. 7, 2015

(54) IMAGE HEATING DEVICE

(71) Applicant: CANON KABUSHIKI KAISHA, Tokyo (JP)

(72) Inventors: Keigo Kaji, Abiko (JP); Ryo Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/209,774

(22) Filed: Mar. 13, 2014

(65) Prior Publication Data

US 2014/0286656 A1 Sep. 25, 2014

(30) Foreign Application Priority Data

Mar. 19, 2013 (JP) ..... 2013-056226

(51) Int. Cl.
*G03G 15/20* (2006.01)
*G03G 15/00* (2006.01)

(52) U.S. Cl.
CPC ..... *G03G 15/205* (2013.01); *G03G 15/55* (2013.01); *G03G 15/5012* (2013.01); *G03G 2215/2035* (2013.01)

(58) Field of Classification Search
CPC .. G03G 15/205; G03G 15/5012; G03G 15/55
USPC ..... 399/33, 67, 329
See application file for complete search history.

(56) References Cited

U.S. PATENT DOCUMENTS

2009/0257767 A1* 10/2009 Funabiki ..... 399/68
2011/0026983 A1* 2/2011 Okamoto ..... 399/302

FOREIGN PATENT DOCUMENTS

JP 2002-287542 A 10/2002

* cited by examiner

*Primary Examiner* — Benjamin Schmitt
(74) *Attorney, Agent, or Firm* — Canon U.S.A., Inc. IP Division

(57) ABSTRACT

An image heating device includes a belt, a light emitting portion, a light receiving portion, and a control portion. The belt heats an image on a sheet in an image heating operation. The light emitting portion emits light from one widthwise end of the belt to the other widthwise end of the belt such that the light passes near a peripheral surface of the belt. The light receiving portion receives the light from the light emitting portion. The control portion controls, according to an output of the light receiving portion, whether or not to prohibit the image heating operation.

16 Claims, 8 Drawing Sheets

IMAGE HEATING DEVICE

BACKGROUND OF THE INVENTION

1. Field of the Invention

The present invention relates to an image heating device that heats an image on a sheet.

2. Description of the Related Art

An image forming apparatus, such as a printer, a copying machine, a facsimile machine, or a multi-functional apparatus of these machines, which includes a fixing device (image heating device) of a belt heating type using a fixing belt (endless belt) has hitherto been put into practical use. In such a fixing device, a toner image, which is formed and born on a sheet (recording material) by an image forming method such as an electrophotographic process or an electrostatic recording process, is fixed on a surface of the recording material by heating.

Since such a fixing device of the belt heating type uses a thin fixing belt having low heat capacity and high thermal responsiveness, the temperature of the fixing belt can reach a fixing temperature in a short time from power-on. This greatly contributes to power saving of the image forming apparatus.

However, the thin fixing belt may be broken owing to deformation or a flaw caused by any external force. If the fixing belt is broken, an image defect may be caused. Therefore, if the fixing belt is broken, it is preferable to immediately understand the fact and to prohibit a fixing operation (image heating operation). A technique for that purpose is proposed in Japanese Patent Laid-Open No. 2002-287542.

Specifically, in a fixing device described in Japanese Patent Laid-Open No. 2002-287542, a belt mark is put on a fixing belt, and an optical sensor is disposed on a side opposed thereto. With this structure, it is determined that the fixing belt is broken when the optical sensor does not detect the belt mark for a fixed time.

However, in the fixing device described in Japanese Patent Laid-Open No. 2002-287542, if a flaw is made on the belt mark or a foreign substance adheres to the belt mark, the amount of light (amount of reflected light) received by the optical sensor decreases and becomes unstable. Hence, a breakage of the fixing belt may be detected erroneously.

SUMMARY OF THE INVENTION

An image heating device according to an aspect of the present invention includes a belt configured to heat an image on a sheet in an image heating operation, a light emitting portion configured to emit light from one widthwise end of the belt to the other widthwise end of the belt such that the light passes near a peripheral surface of the belt, a light receiving portion configured to receive the light from the light emitting portion, and a control portion configured to control, according to an output of the light receiving portion, whether or not to prohibit the image heating operation.

Further features of the present invention will become apparent from the following description of exemplary embodiments with reference to the attached drawings.

DESCRIPTION OF THE EMBODIMENTS

Embodiments of the present invention will be described below with reference to the drawings. While an image heating device of each embodiment is applied to a fixing device that fixes an unfixed toner image onto a sheet (recording material), the present invention is also applicable to a heat treatment device that heats a recording material bearing a fixed image or a semi-fixed image to adjust the surface texture of the image. The dimensions, materials, shapes, and relative arrangements of the constituent components adopted in the embodiments should be appropriately changed according to the configuration and various conditions of the device to which the present invention is applied, and are not intended to be limited to the following embodiments.

First Embodiment

Figure 2:
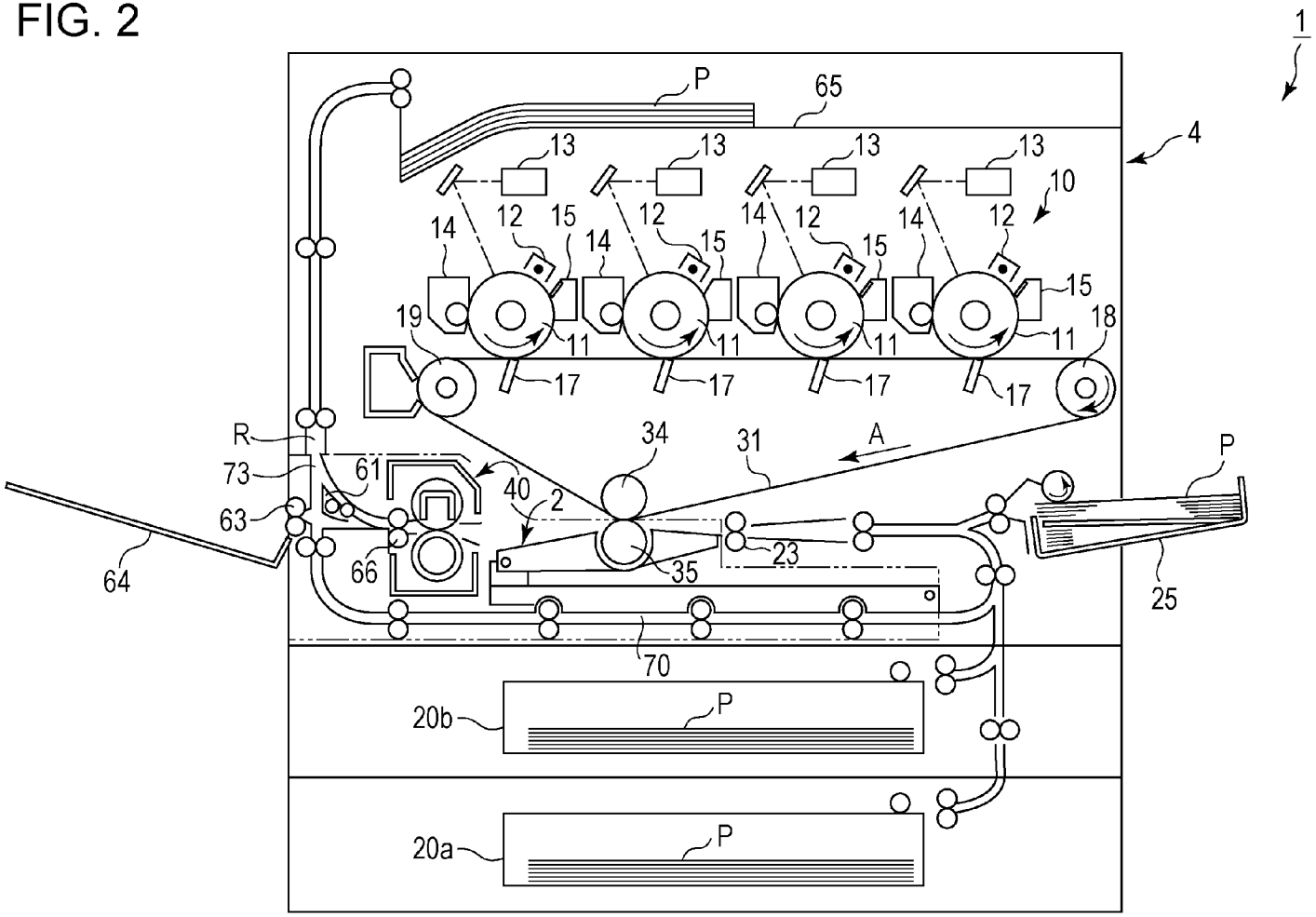
FIG. 2 is a schematic configuration view of an image forming apparatus including the fixing device.

First, an electrophotographic color printer serving as an image forming apparatus to which the present invention is applicable will be described with reference to FIG. 2. FIG. 2 is a cross-sectional view of the electrophotographic color printer, taken in a sheet conveying direction. In the following description of the first embodiment, the electrophotographic color printer will be simply referred to as a "printer."

[Printer]

As illustrated in FIG. 2, a printer 1 includes a printer main body 4. The printer main body 4 includes image forming sections 10 corresponding to Y (yellow), M (magenta), C (cyan), and Bk (black) colors. Each of the image forming sections 10 includes a photosensitive drum 11, and a charger 12, a laser scanner 13, a developing unit 14, a primary transfer blade 17, and a cleaner 15 that are arranged in order in a rotating direction of the photosensitive drum 11.

In each of the image forming sections 10, the photosensitive drum 11 is charged by the charger 12 beforehand, and an electrostatic latent image is formed thereon by the laser scanner 13. The electrostatic latent image is developed into a visible toner image by the developing unit 14. Toner images formed on the photosensitive drums 11 corresponding to the colors are sequentially transferred onto an intermediate transfer belt 31 serving as an image bearing member so as to form a color toner image. After this transfer, toner remaining on each photosensitive drum 11 is removed by the cleaner 15. Hence, a surface of the photosensitive drum 11 is cleaned and can prepare for the next image forming operation.

In contrast, recording materials P are fed one by one from a first sheet cassette 20*a*, a second sheet cassette 20*b*, or a multipurpose sheet tray 25 provided on one side of the printer 1, and a fed recording material P is sent between a pair of registration rollers 23. The registration rollers 23 temporarily receive the recording material P and correct skew feeding. Then, the registration rollers 23 send the recording material P into a secondary transfer nip between the intermediate transfer belt 31 and a secondary transfer roller 35 in synchronization with the toner image on the intermediate transfer belt 31.

The intermediate transfer belt 31 is supported by tension rollers 18, 19, and 34 to be rotatable in a direction of arrow A.

The color toner image on the intermediate transfer belt 31 is transferred onto the recording material P by the secondary transfer roller 35 serving as a transfer member. After that, the recording material P is heated and pressed by a fixing device 40, and a toner image t (see FIG. 1) is fixed on the recording material (sheet) P. In FIG. 2, reference numeral 2 denotes a pre-fixing guide that guides the recording material P to the fixing device 40 before fixing.

When a toner image is to be formed on one side of the recording material P, a conveyance path is switched by a switch member (flapper) 61 according to the condition. When the recording material P is to be discharged face up (the toner image faces up), it is discharged via sheet discharge rollers 63 onto a sheet discharge tray 64 disposed on a side surface of the printer 1. In contrast, when the recording material P is to be discharged face down (the toner image faces down), it is discharged onto a sheet discharge tray 65 disposed in an upper part of the printer 1.

When a toner image is to be formed on each side of the recording material P, after a toner image is fixed on one side of the recording material P by the fixing device 40, the recording material P is guided upward by the switched switch member 61, and is turned upside down by being switched back into a switchback conveyance path 73 when a trailing edge of the recording material P reaches a reverse point R. After that, the recording material P is conveyed through a duplex conveyance path 70, and a toner image is formed on the other side of the recording material P through a process similar to that for one-sided image formation. Then, the recording material P is discharged onto the sheet discharge tray 64 or the sheet discharge tray 65. A section constituted by the switch member 61, the switchback conveyance path 73, etc. is an example of a reversing unit.

[Fixing Device]

Figure 1:
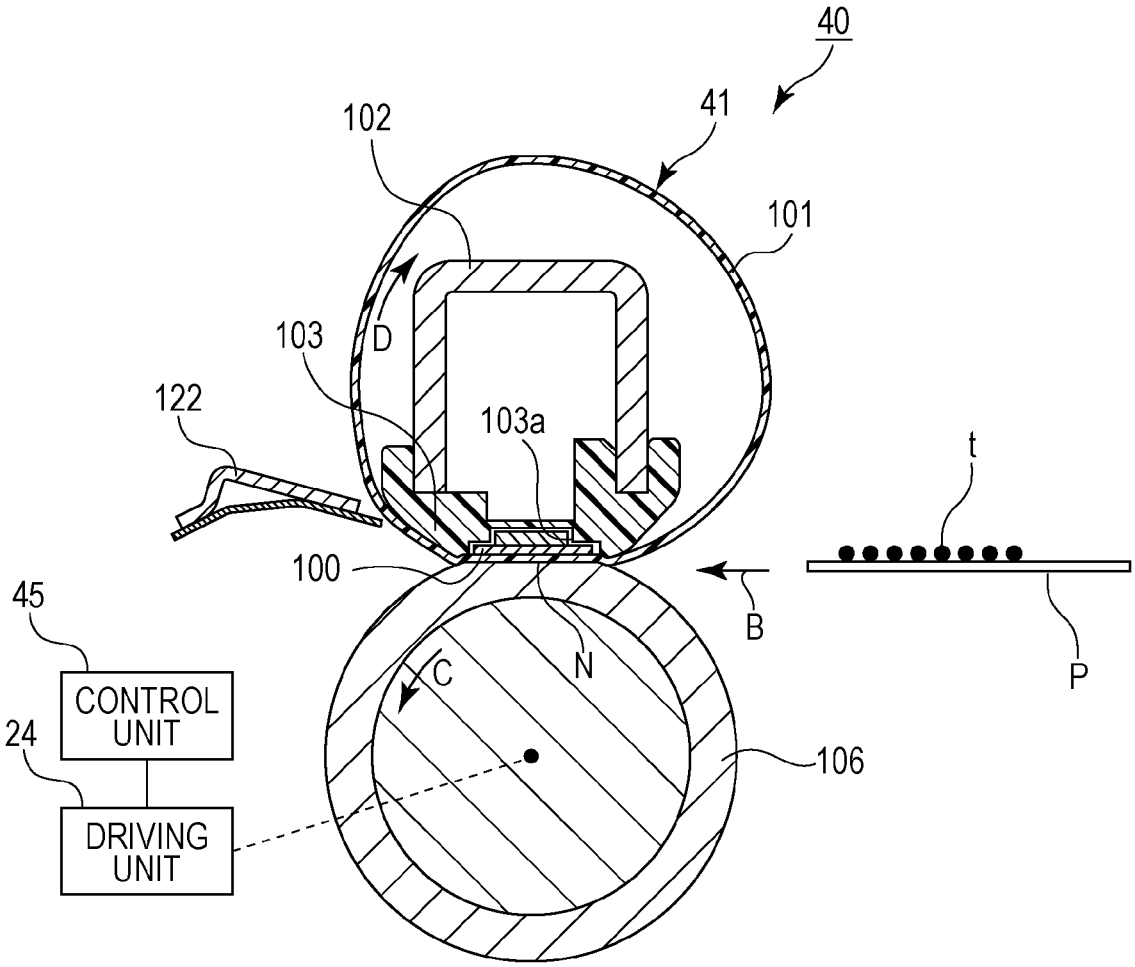
FIG. 1 is a cross-sectional view schematically illustrating a fixing device according to an embodiment of the present invention.
Figure 3:
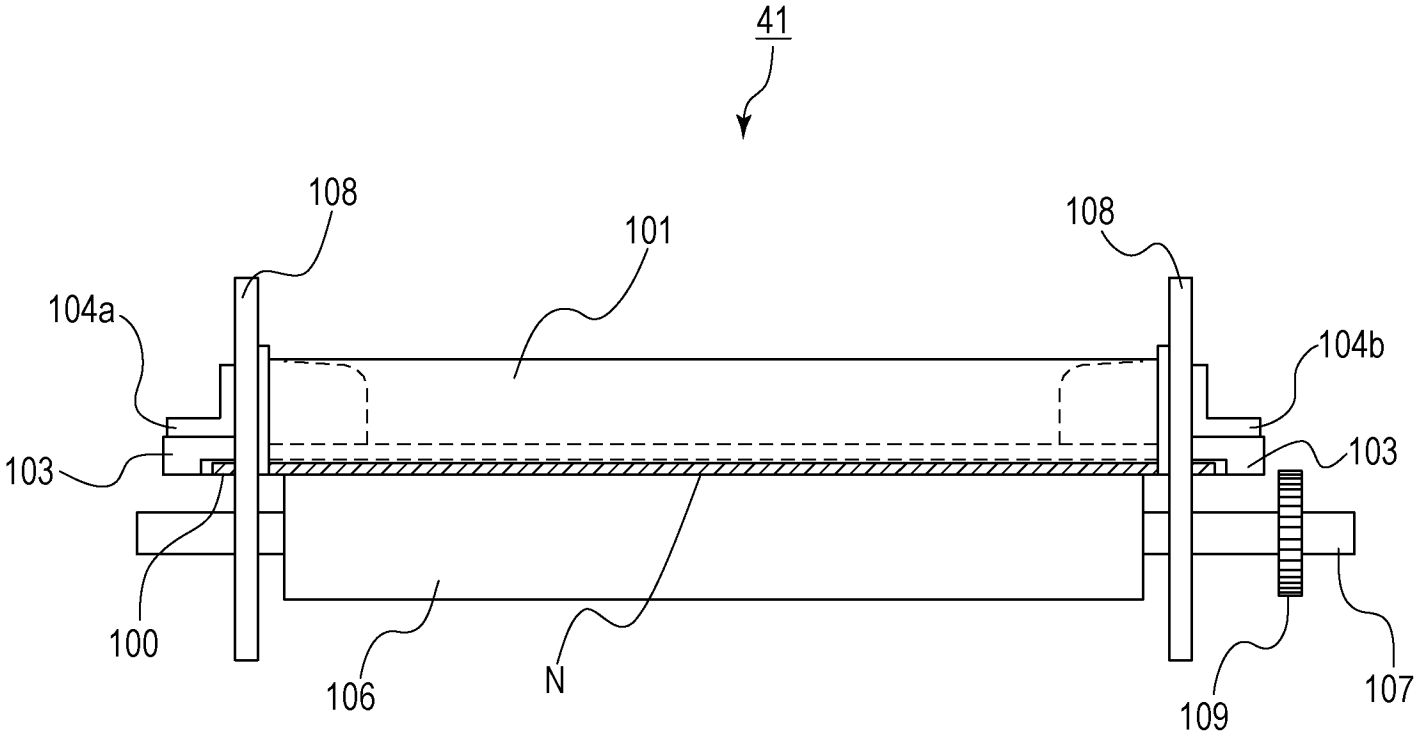
FIG. 3 is a side view of a fixing device according to a first embodiment of the present invention.

Next, the fixing device 40 according to the first embodiment will be described with reference to FIGS. 1 and 3. FIG. 1 is a schematic cross-sectional view of the fixing device 40, taken along a sheet (recording material) conveying direction, and FIG. 3 is a side view of the fixing device 40, as viewed from a right side of FIG. 1.

The fixing device 40 is an example of a belt heating type fixing device. The fixing device 40 includes a pressing roller 106 serving as a driving rotating member or a rotating member, and a fixing unit 41 opposed to the pressing roller 106 and serving as an image heating member. The fixing unit 41 includes a ceramic heater 100 serving as a heater therein. The pressing roller 106 serving as the driving rotating member forms a fixing nip (nip) N in cooperation with a fixing belt 101 serving as an endless belt, and drives the fixing belt 101.

The fixing unit 41 includes a cylindrical fixing film (hereinafter referred to as a fixing belt) 101 serving as an endless belt, and a guide member 103 that forms the fixing nip N with the pressing roller 106 such that the fixing belt 101 is located therebetween. The guide member 103 extends long to have a length nearly equal to an axial length of the fixing belt 101 and the pressing roller 106. The fixing belt 101 is heated by the ceramic heater 100 (heating mechanism) and is supported to be rotatable in a circumferential direction (a direction of arrow D in FIG. 1). The pressing roller (rotating member) 106 is supported to be rotatable in a direction of arrow C in FIG. 1 while forming the fixing nip (nip) N by contact with the fixing belt 101.

The fixing unit 41 further includes fixing flanges 104*a* and 104*b* and a stay 102. The fixing flanges 104*a* and 104*b* are disposed at both axial ends of the fixing belt 101, respectively, to regulate a circumferential track of the fixing belt 101. The stay 102 is disposed on an inner surface side of the fixing belt 101 to ensure strength of the guide member 103.

The printer main body 4 further includes a control unit 45 serving as a breakage determining unit (a control portion). The control unit 45 controls the parts of the printer 1, and determines, on the basis of a change in a light receiving state of a light receiving part 121 serving as a light receiving member (a light receiving portion, see FIG. 4), that the fixing belt 101 is broken. The fixing device 40 further includes a driving unit 24, such as a motor, connected to the control unit 45, such as a CPU, to rotationally drive the pressing roller 106. The control unit 45 also functions as a prohibition unit. The control unit 45 serving as the prohibition unit prohibits an image heating operation when the amount of light received by the light receiving part 121 is not larger than a predetermined amount. For example, the control unit 45 prohibits the image heating operation by at least one of a method of stopping a heating operation with a heater, such as the ceramic heater 100, and a method of stopping driving of the pressing roller 106. The control unit 45 may be provided separately from a control unit for controlling the parts of the printer 1, and be disposed in the fixing device 40. In this case, the control unit 45 controls the members of the fixing device 40, separately from the control unit for controlling the members of the printer 1.

The members will be described in detail below. First, the members that constitute the fixing unit 41 will be described.

The fixing belt 101 in the fixing unit 41 is formed by a heat-resistant cylindrical member that transfers heat to a recording material P, and is loosely fitted on the guide member 103. For example, the fixing belt 101 can be formed by a thin metal film having a thickness within the range of 20 to 100 μm, preferably to 50 μm. As the thin metal film, a composite-layer film obtained by coating an outer peripheral surface of SUS with PTFE, PFA, or FEP, can be used, for example.

The fixing belt 101 has a structure in which an elastic layer or a release layer is appropriately provided on a heat-resistant base material having a thickness within the range of 20 to 100 μm, preferably, to 50 μm. As the fixing belt 101, the following composite-layer belt can be used. That is, for example, the composite-layer belt is formed by coating a base material, in which a heat-conducting filler is mixed in a material mainly composed of resin such as PTFE, PFA, FEP, polyimide, polyamideimide, PEEK, PES, or PPS, with a release layer of PTFE, PFA, or FEP. As the base material, a thin metal belt of, for example, SUS having a thickness within the range of 20 to 50 μm may be used. To obtain a color image with little unevenness, an elastic layer formed of, for example, silicone rubber in which a heat-conducting filler is added may be disposed between the base material and the release layer.

On an inner side of the fixing belt 101, the guide member 103 is disposed to extend long with a length slightly more than the longitudinal length of the fixing belt 101. The guide member 103 is formed of a heat-resistant and heat-insulating material. As this material, a material that has high insulation and high heat resistance, such as phenol resin, polyimide resin, polyamide resin, polyamideimide resin, PEEK resin, PES resin, PPS resin, PFA resin, PTFE resin, or LCP resin, can be used. The guide member 103 is in pressure contact with the pressing roller 106 to assist pressurization at the fixing nip N formed between the fixing belt 101 and the pressing roller 106 and to function as a guide for stabilizing the rotation of the fixing belt 101.

In a lower surface of the guide member 103 in FIG. 1, a fitting groove 103*a* extends in the longitudinal direction. The ceramic heater 100 having a length nearly equal to the length of the fitting groove 103*a* is fitted and supported in the fitting groove 103*a*. The ceramic heater 100 is a heater having a low heat capacity, and is increased in temperature with a totally steep rise characteristic by energization of a heating resistor layer. For example, in the ceramic heater 100, an energizing heating resistor layer is provided on a ceramic substrate shaped like an elongated thin plate.

The stay 102 is disposed on the guide member 103. The stay 102 has a length nearly equal to the longitudinal length of the guide member 103. The stay 102 is pressed against a back surface of the guide member 103 made of comparatively soft resin to impart longitudinal strength to the guide member 103 and to correct the guide member 103.

The fixing flanges 104*a* and 104*b* are fitted in both longitudinal ends of the stay 102, respectively. These fixing flanges 104*a* and 104*b* have side wall portions that guide the circumferential rotation of the fixing belt 101 and function as thrust stops for regulating movement of the fixing belt 101 in the widthwise direction (right-left direction in FIG. 3). The fixing flanges 104*a* and 104*b* are fitted in and held by side plates 108 disposed at both axial ends of the fixing belt 101 and the pressing roller 106, respectively. This ensures the position of the entire fixing unit 41.

The pressing roller 106 located on a lower side of the fixing belt 101 is supported by the side plates 108 provided at both axial ends such a rotation shaft (a cored bar 107) thereof is rotatable. The pressing roller 106 is also pressed toward the fixing belt 101 by an unillustrated pressing mechanism to form the fixing nip N.

On a downstream side of the fixing nip N in a recording-material conveying direction (a direction of arrow B in FIG. 1), a separation guide 122 is disposed close to the fixing belt 101. The separation guide 122 separates a recording material P from the fixing belt 101 after fixing. A predetermined gap is provided at a distal end of the separation guide 122 so as not to contact the fixing belt 101 even during rotational driving of the fixing belt 101.

Next, the pressing roller (rotating member) 106 serving as the pressing member will be described in detail with reference to FIG. 3.

That is, as illustrated in FIG. 3, the pressing roller 106 includes the cored bar 107 that extends in an axial direction (a right-left direction in FIG. 3) to serve as a rotation shaft for the pressing roller 106, and a roller-shaped covering layer provided around the cored bar 107. The covering layer is molded integrally and concentrically with the cored bar 107 to cover the cored bar 107. A release layer is provided on a surface of the pressing roller 106. The covering layer provided around the cored bar 107 is formed of a heat-resistant elastic material such as silicone rubber, fluoro rubber, or fluoro resin. As the release layer, a material having high releasability and high heat resistance, such as fluoro resin, silicone resin, fluoro silicone rubber, fluoro rubber, silicone rubber, PFA, PTFE, or FEP, can be selected.

Unillustrated bearing members formed of a heat-resistant resin, such as PEEK, PPS, or a liquid crystal polymer, are attached to both ends of the cored bar 107, respectively. These bearing members allow the cored bar 107 to be rotatably held in the side plates 108. A gear 109 is attached to one longitudinal end of the cored bar 107. The pressing roller 106 is rotationally driven by the rotation received from the driving unit 24, which is controlled by the control unit 45 (FIG. 1), to the cored bar 107 via the gear 109. When the pressing roller 106 rotates, the fixing belt 101 in contact with the pressing roller 106 drags (rotates) along with the rotation of the pressing roller 106.

To smoothen the rotation of the fixing belt 101 by reducing the frictional force between the fixing belt 101, and the ceramic heater 100 and the guide member 103, an inner peripheral surface of the fixing belt 101, or the surfaces of the ceramic heater 100 and the guide member 103 may be coated with an unillustrated lubricant. As the lubricant, heat-resistant oil or grease is preferably used. For example, silicone oil, PFPE (perfluorinated polyether), or fluoro grease can be used.

[Structure for Determining Belt Breakage]

Figure 4:
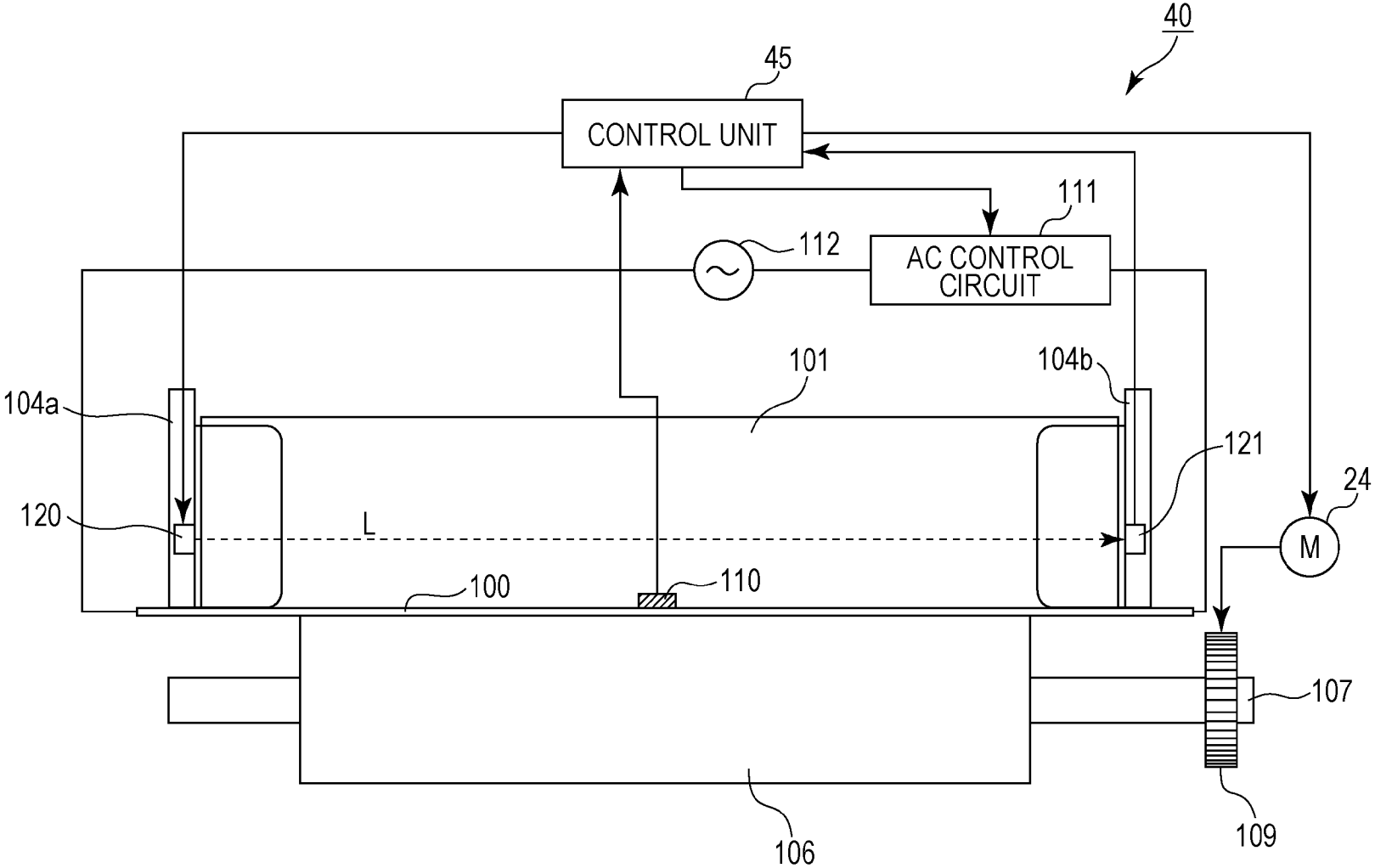
FIG. 4 is a functional block diagram of the fixing device of the first embodiment.
Figure 5:
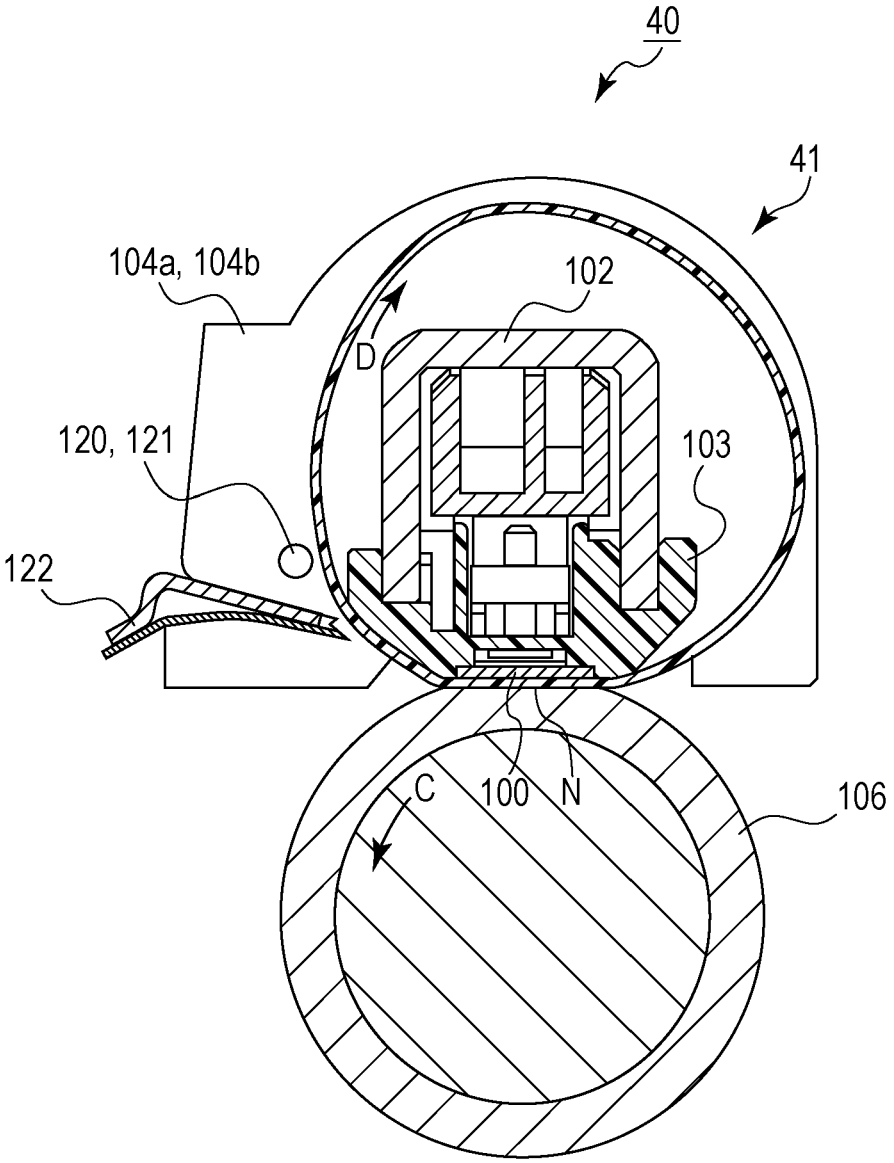
FIG. 5 is a cross-sectional view of the fixing device of the first embodiment, taken along a flange.

Next, the operation of the fixing device 40 and determination of a breakage of the fixing belt 101 will be described with reference to FIGS. 4 and 5. FIG. 4 is a functional block diagram of the fixing device 40, and FIG. 5 is a cross-sectional view of the side wall portions of the fixing flanges 104*a* and 104*b* in the fixing device 40.

As illustrated in FIG. 4, the driving unit 24, such as a motor, a light source 120, the light receiving part 121, and an AC control circuit 111 are connected to the control unit (breakage determining unit) 45. The control unit 45 controls the parts of the fixing device 40, and performs control, on the basis of light received by the light receiving part 121, so as to stop the driving of the driving unit 24 to stop the pressing roller 106 and the rotation of the fixing belt 101 when detecting a breakage of the fixing belt 101. The gear 109 is fixed to one end of the rotation shaft (cored bar 107) of the pressing roller 106. A pinion (not illustrated) fixed to, for example, a motor rotation shaft of the driving unit 24 is meshed with the gear 109, and the rotation of the driving unit 24 is controlled by the control unit 45.

A thermistor 110 serving as a temperature detector is attached to an axial center portion of a surface of the ceramic heater 100 on which the fixing belt 101 does not slide. The thermistor 110 is connected to the control unit 45. An AC power supply 112 and the AC control circuit 111 are connected to the ceramic heater 100, and energization of the ceramic heater 100 is controlled by the control unit 45.

The light source 120 functioning as a light emitting part (light emitting member, light projecting member, light emitting portion) is disposed on the side wall portion of the fixing flange 104*a* on a side opposite from the gear 109 (a left side of FIG. 4). The light source 120 is located on an outer side of the track of the rotating fixing belt 101 on the side wall portion, and is disposed on a downstream side of the separation guide 122, which is disposed on a downstream side of the fixing nip N, in a rotating direction of the fixing belt 101 (a direction of arrow D in FIG. 5) (on an upper side of the separation guide 122 in FIG. 5). The light source 120 emits light from one widthwise end toward the other widthwise end of the fixing belt 101 (endless belt) so that the light passes near the peripheral surface of the fixing belt 101. Such arrangement of the light source 120 can prevent a recording material P passing through the fixing nip N from obstructing a below-described optical path L.

In the first embodiment, the light source 120 is disposed at one widthwise end of the fixing belt 101, and the light receiving part 121 serving as the light receiving member is disposed at the other widthwise end of the fixing belt 101. That is, the light receiving part 121 for receiving light from the light source 120 is disposed on the side wall portion of the fixing flange 104*b* located on the side of the gear 109 in FIG. 4. The light receiving part 121 is attached at a position such as to receive emergent light (L) that is emitted from the light source 120 on the side wall portion of the opposed fixing flange 104*a* and passes near an outer side of an outer peripheral side of the fixing belt 101. That is, the light receiving part 121 on one fixing flange 104*b* is disposed at a position opposed to the light source 120 on the other fixing flange 104*a* and at a cross-sectional position substantially equal to that of the light source 120.

As described above, the light source 120 is positioned to emit light so that the light passes near the peripheral surface of the fixing belt 101 between both widthwise ends of the fixing belt 101, that is, passes near the outer side of the peripheral surface of the fixing belt 101. Alternatively, the light source 120 can be positioned to emit light so that the light passes near an inner side of the peripheral surface of the fixing belt 101. In this case, similar advantages can also be obtained.

In the first embodiment, the distance between the track of the fixing belt 101 during rotation and the optical path L is preferably as short as possible. However, a structure is adopted to prevent the optical path L from being obstructed by a bulging portion of the fixing belt 101 when the track becomes unstable at the start of rotation and bulges outward from the normal track.

The light source 120 can be selected from a laser light source for emitting laser light and an LED light source, for example. As the light receiving part 121, an optical sensor, such as a phototransistor, which can receive and detect light from the light source 120 can be used. When the light source 120 and the light receiving part 121 are selected, they are preferably insusceptible from the influences of light from the parts other than the light source 120 and radiation from the fixing belt 101.

In the first embodiment, a laser light source having high directivity is used as the light source 120, and a phototransistor capable of detecting the laser light from the light source 120 is used as the light receiving part 121. The optical path L refers to a path of laser light extending from the light source 120 to the light receiving part 121.

In a state in which the fixing belt 101 is normal, since the optical path L extending from the light source 120 to the light receiving part 121 is not obstructed, the amount of light received by the light receiving part 121 is sufficiently large. In contrast, if the fixing belt 101 breaks and a part thereof enters the optical path L, the part obstructs the optical path L, and reduces the amount of light received by the light receiving part 121.

In the first embodiment, when the control unit 45 serving as the breakage determining unit detects that the amount of light received by the light receiving part 121 falls to a predetermined threshold value (predetermined value) or less, it determines that the fixing belt 101 is broken. That is, the threshold value of a belt-breakage determining light amount from which the control unit 45 determines that the fixing belt 101 is broken is set to be more than the light amount obtained when the optical path L is obstructed and less than the light amount obtained when the optical path L is not obstructed. Hence, it can be accurately determined whether or not a broken part of the fixing belt 101 exists on the optical path L. This structure can be similarly adopted in a second embodiment described below.

Next, a description will be given of the operation of the first embodiment including a fixing operation performed during printing.

That is, when the control unit 45 receives instructions to start a fixing operation, it operates the AC control circuit 111 to start power feeding to the ceramic heater 100. The power feeding to the ceramic heater 100 is continued until the detection temperature of the thermistor 110 reaches a predetermined target temperature T1 (for example, 200° C.)

The control unit 45 drives the driving unit 24, such as a motor, at a time point when the detection temperature of the thermistor 110 reaches a motor driving start temperature T2 lower than the target temperature T1. Thus, the pressing roller 106 is rotationally driven by driving of the driving unit 24, and the fixing belt 101 rotates along with the rotation of the pressing roller 106.

The control unit 45 starts a sheet feed operation at a time point when the detection temperature of the thermistor 110 reaches the target temperature T1. Thus, a recording material P bearing an unfixed toner image is guided along the pre-fixing guide (entrance guide) 2, and is introduced into the fixing nip N.

During the fixing operation, the control unit 45 controls electric power supplied from the AC control circuit 111 to the ceramic heater 100 so that the detection temperature of the thermistor 110 is stabilized near the target temperature T1. In the fixing nip N, a surface of the recording material P on which the toner image is born is brought into tight contact with the outer surface of the fixing belt 101, and moves together with the fixing belt 101.

In a process in which the recording material P is nipped and conveyed in the fixing nip N, heat generated by the ceramic heater 100 is given to the recording material P, whereby an unfixed toner image (t in FIG. 1) is melted and fixed on the recording material P. After passing through the fixing nip N, the recording material P is curvature-separated from the fixing belt 101, and is discharged by fixing discharge rollers 66 (FIG. 2). When the print operation is completed, the control unit 45 stops power feeding to the ceramic heater 100, and stops the driving unit 24, such as a motor, to stop the rotations of the pressing roller 106 and the fixing belt 101.

Figure 6:
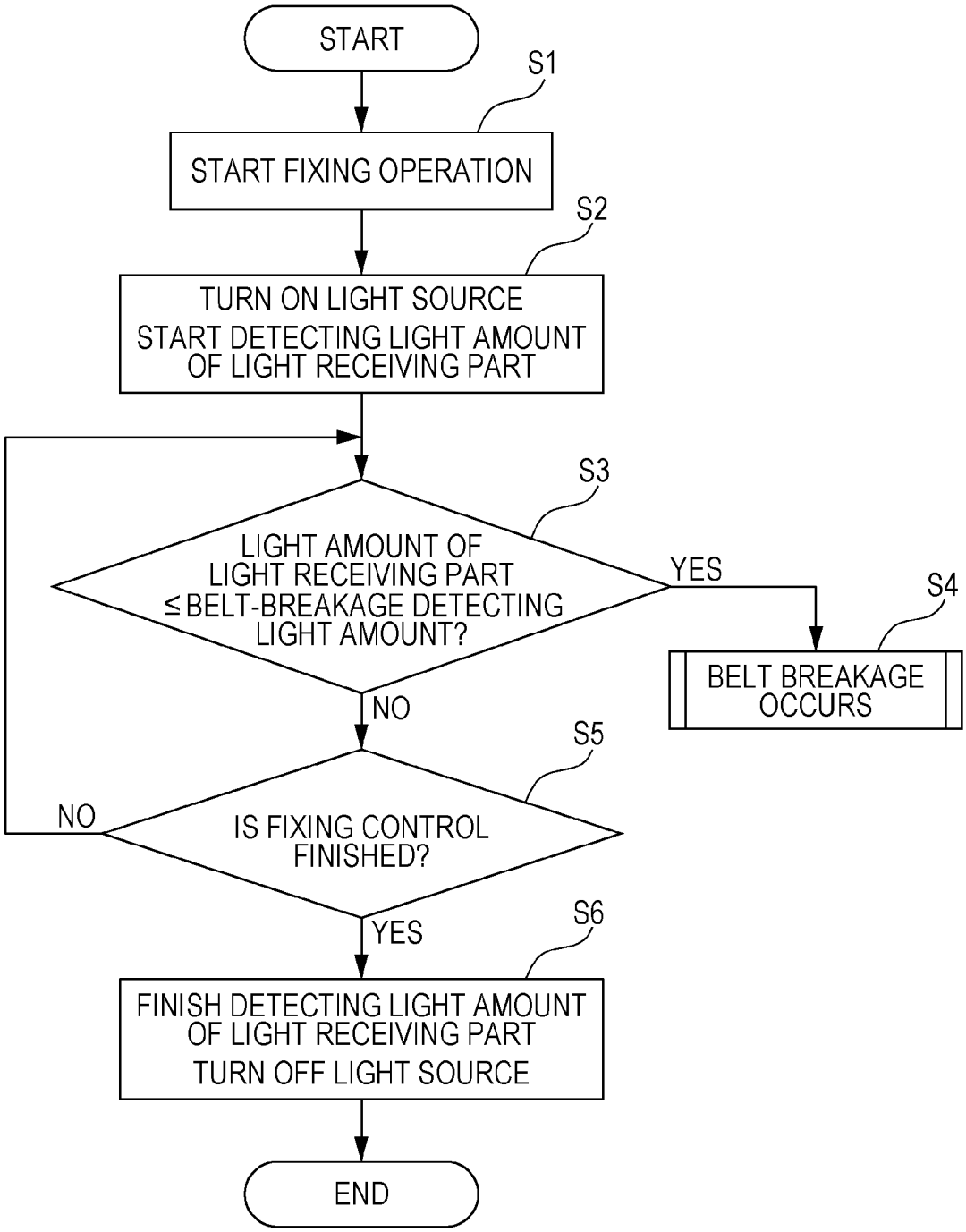
FIG. 6 is a flowchart showing a belt breakage detection sequence according to the first embodiment.

Next, the basic control flow in the belt breakage determination sequence of the first embodiment will be described along a flowchart of FIG. 6.

When the control unit 45 receives the instructions to start the fixing operation at the start of printing, it starts the above-described fixing operation, turns on the light source 120, and starts monitoring the light amount of the light receiving part 121 (detection of the light amount of the light receiving member) (Steps S1 and S2).

Then, the control unit 45 compares the light amount of the light receiving part 121 and the belt-breakage determining light amount at a predetermined sampling interval (S3). That is, in Step S3, the light amount of the light receiving part 121 and the belt-breakage determining light amount are compared, and it is thereby determined whether or not the light amount of the light receiving part 121 (amount of light received by the photosensor) becomes less than or equal to the predetermined threshold value (predetermined value) serving as the belt-breakage determining light amount.

As a result, when determining that the light amount of the light receiving part 121 becomes less than or equal to the belt-breakage determining light amount, the control unit 45 determines that a breakage of the fixing belt 101 occurs (S4). In contrast, when determining that the light amount of the light receiving part 121 is not less than or equal to the belt-breakage determining light amount, the control unit 45 continues monitoring with the light receiving part 121 until the fixing control is completed (S5).

When the control unit 45 determines in Step S5 that the fixing control is completed, it finishes the detection of the sensor light amount with the light receiving part 121, turns off the light source 120 (S6), and completes a series of steps.

When the control unit 45 determines in Step S4 that the breakage of the fixing belt 101 occurs, it stops power feeding to the ceramic heater 100, and stops the driving of the driving unit 24 such as a motor. Further, the control unit 45 displays, on an unillustrated display unit, the necessity to replace the fixing belt 101 in the fixing device 40. Alternatively, the control unit 45 can display a message that notifies the failure of the fixing device 40.

Figure 7:
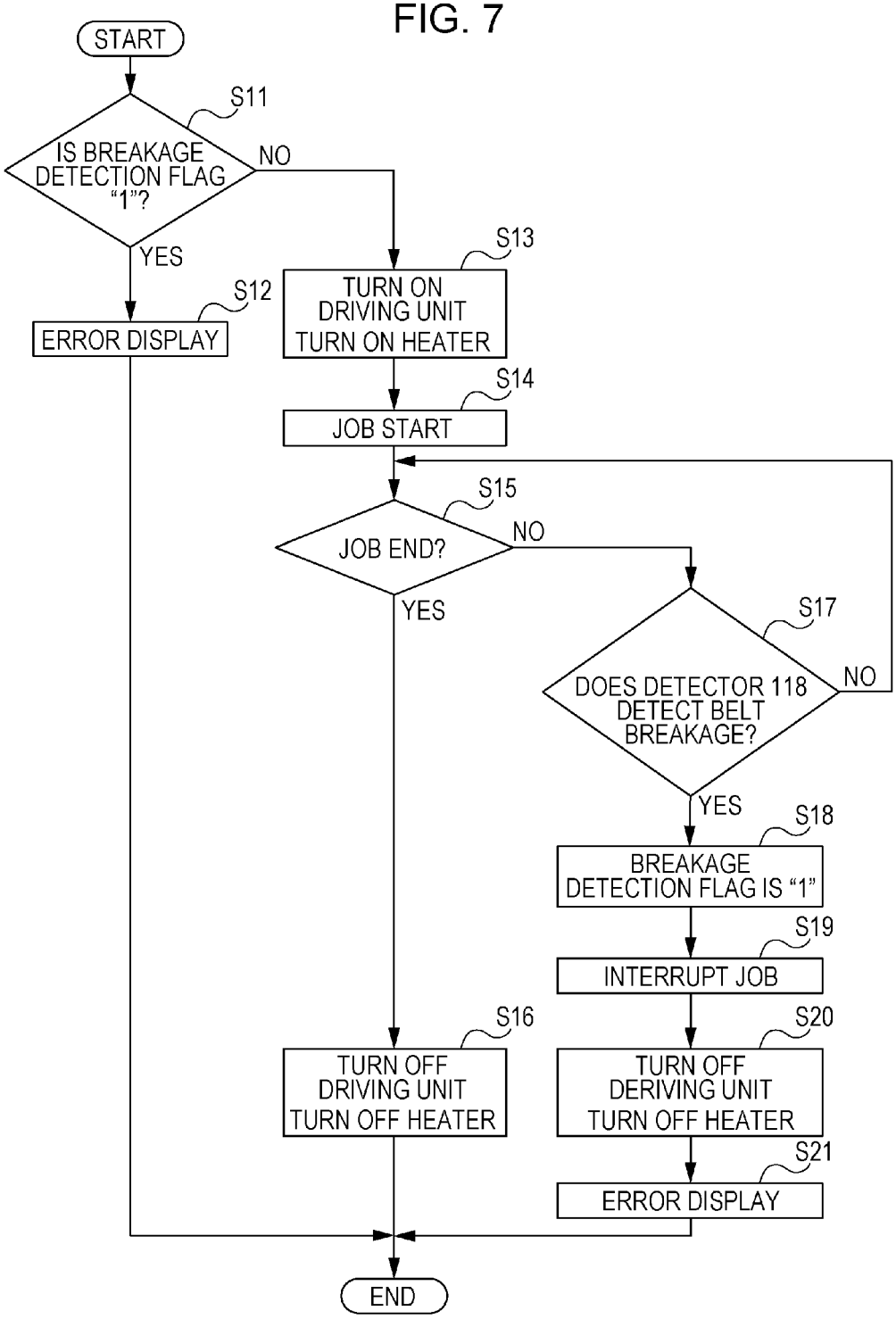
FIG. 7 is a flowchart showing an operation performed when a belt breakage is detected in the first embodiment.

An operation performed when it is determined in Step S4 that the breakage of the fixing belt 101 occurs will now be described with reference to FIG. 7 showing a subroutine. FIG. 7 is a flowchart of the operation of the image forming apparatus.

First, when a job start command is issued by the control unit 45 formed by the CPU, breakage detection information (a breakage detection flag) stored in a memory is checked (Step S11). When the breakage detection information is "1", error display is performed (S12), reception of a job is prohibited, and the operation is finished.

In contrast, when the breakage detection information is "0", the control unit 45 turns on the driving unit 24 to rotate the pressing roller 106, turns on the ceramic heater 100 to start heating (S13), and starts a job (S14).

In a normal state in which the fixing belt 101 is not broken, the job is executed until a job end signal is sent from the control unit 45. When the job end signal is sent (S15), the rotation of the pressing roller 106 is stopped by the driving unit 24, heating with the ceramic heater 100 is stopped (S16), and the operation is completed.

In contrast, when a detector 118 of the control unit 45 detects a breakage of the fixing belt 101 between the job start (S14) and the job end (S15) (S17), the control unit 45 determines that the fixing belt 101 is broken, and stores breakage detection information "1" in the memory (S18). Then, the active job is immediately interrupted (S19), the driving unit 24 is turned off to stop the rotation of the pressing roller 106, the ceramic heater 100 is turned off to stop heating (S20), error display is performed (S21), and the operation is completed. While the image heating operation is prohibited both by stopping the driving of the pressing roller 106 and by turning off the ceramic heater 100 here, it can be prohibited by performing any one of these methods.

When the belt breakage determination is made in Step S4, it is preferable to clearly distinguish a belt breakage from a sudden decrease in sensor received light amount, for example, due to noise. For that purpose, when a decrease in photosensor received light amount for a short time is detected, without immediately determining that a breakage occurs, it may be determined that a breakage occurs when a decrease in photosensor received light amount is detected again in a rotation period.

That is, when the control unit 45 detects, a predetermined number of times during a predetermined rotation of the fixing belt 101, a situation in which the amount of light received by the light receiving part 121 falls to the predetermined value or less, it determines that the fixing belt 101 is broken. This can further increase the accuracy of the belt breakage determination. This structure can be similarly adopted in a second embodiment described below.

Alternatively, when a decrease in photosensor received light amount is continuously detected for a predetermined time or more, it may be determined that the fixing belt 101 is broken. That is, when the control unit 45 continuously detects, for the predetermined time or more, the situation in which the amount of light received by the light receiving part 121 is less than or equal to the predetermined value, it determines that the fixing belt 101 is broken. This can further increase the accuracy of the belt breakage determination. This structure can be similarly adopted in the second embodiment described below.

Second Embodiment

Figure 8:
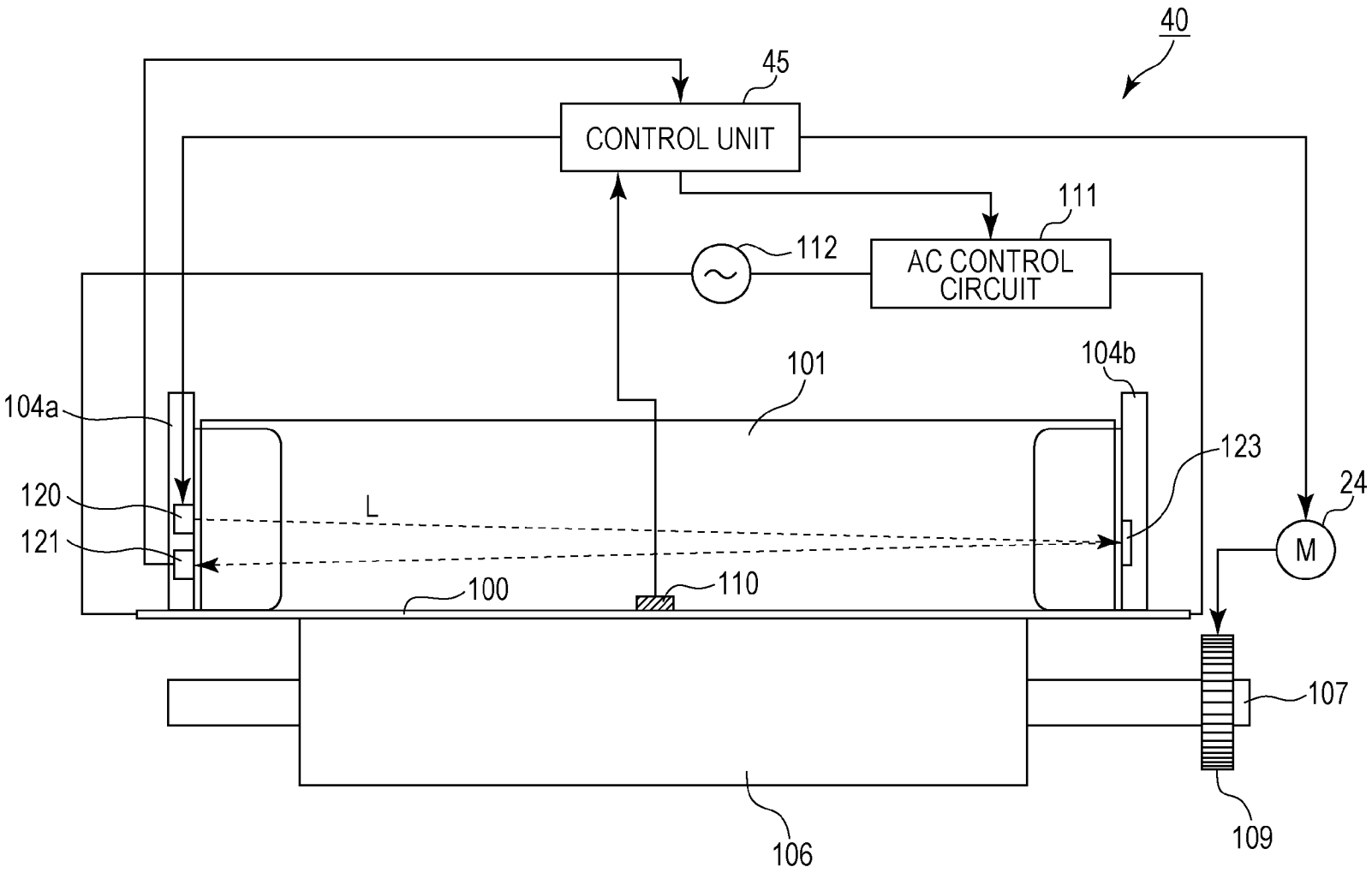
FIG. 8 is a functional block diagram of a fixing device according to a second embodiment of the present invention.

Next, a second embodiment of the present invention will be described with reference to FIG. 8. FIG. 8 is a side view of a fixing device in the second embodiment. In the second embodiment, members having the same functions as those of the members adopted in the above-described first embodiment are denoted by the same reference numerals, and redundant descriptions thereof are skipped.

As illustrated in FIG. 8, in a fixing device 40 of the second embodiment, a light source (light emitting member, light projecting member) 120 and a light receiving part (light receiving member) 121 are disposed together on a side of one fixing flange 104*a*, and a reflecting part 123 serving as a reflecting member is disposed on a side of the other fixing flange 104*b*.

The reflecting part 123 formed by, for example, a reflection mirror is attached at a position such as to reflect emergent light (L), which is emitted from the light source 120 on a side surface of the opposed fixing flange 104*a* and passes near an outer side of an outer peripheral surface of a fixing belt 101, and to allow the light receiving part 121 adjacent to the light source 120 to receive the reflected light. That is, in the second embodiment, the light source 120 and the light receiving part 121 are disposed at one widthwise end of the fixing belt 101, and the reflecting part 123 serving as the reflecting member for reflecting light from the light source 120 and returning the light to the light receiving part 121 is disposed on the other widthwise end of the fixing belt 101.

While the light source 120, the light receiving part 121, and the reflecting part 123 are disposed on the fixing flanges 104*a* and 104*b* in the second embodiment, similar advantages can be obtained even when these members are disposed outside the fixing device 40 as long as they are disposed on outer sides of the longitudinal ends of the fixing belt 101.

While the ceramic heater 100 for directly heating the fixing nip N is used as the heating mechanism in the second embodiment, alternatively, the following structure can be adopted. That is, instead of the ceramic heater 100, a halogen heater can be used as a heating mechanism to heat the fixing belt 101 by radiant heat from the halogen heater. Further alternatively, an IH (electromagnetic induction heating) type heating mechanism can be used to heat the fixing belt 101. The IH type heating mechanism serves as a magnetic-flux generation mechanism that generates magnetic flux for subjecting the fixing belt 101 to electromagnetic induction heating.

According to the second embodiment, advantages substantially similar to those of the first embodiment can be obtained. Moreover, since the light source 120 and the light receiving part 121 can be disposed together on one fixing flange 104*a*, they can be combined into an integrated reflective photodetector. This can achieve space saving and size reduction of the fixing device 40.

While the optical path L extending from the light emitting portion to the light receiving portion passes near the outer peripheral surface of the fixing belt in the above-described first and second embodiments, for example, it may pass near the inner peripheral surface of the fixing belt. In this case, other structures are similar to those adopted in the above embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-056226, filed Mar. 19, 2013, which is hereby incorporated by reference herein in its entirety.

What is claimed is:

1. An image heating device comprising:

a belt configured to heat an image on a sheet in an image heating operation;

a light emitting portion disposed at one end of the belt in a widthwise direction of the belt and configured to emit light from the one end of the belt to the other end of the belt such that the light passes near an outer peripheral surface of the belt;

a light receiving portion disposed at the one end of the belt and configured to receive the light from the light emitting portion;

a reflecting portion disposed at the other end of the belt and configured to reflect the light from the light emitting portion to the light receiving portion; and a control portion configured to control, according to an output of the light receiving portion by receiving the light from the light emitting portion via the reflecting portion, whether to prohibit the image heating operation.

2. The image heating device according to claim 1, further comprising a heating mechanism configured to heat the belt, wherein, according to the output of the light receiving portion, the control portion controls whether to stop a heating operation of the heating mechanism.

3. The image heating device according to claim 2, wherein the control portion stops the heating operation of the heating mechanism when an amount of light received by the light receiving portion is not larger than a predetermined amount.

4. The image heating device according to claim 2, wherein the control portion stops the heating operation of the heating mechanism when it is detected a predetermined number of times within a predetermined time that an amount of light received by the light receiving portion is not larger than a predetermined amount.

5. The image heating device according to claim 2, wherein the control portion stops the heating operation of the heating mechanism when it is detected for a predetermined time that an amount of light received by the light receiving portion is not larger than a predetermined amount.

6. The image heating device according to claim 1, further comprising a driving rotating member configured to form a nip in cooperation with the belt and to drive the belt, wherein, according to the output of the light receiving portion, the control portion controls whether to stop a rotation of the driving rotating member.

7. The image heating device according to claim 6, wherein the control portion stops the rotation of the driving rotating member when an amount of light received by the light receiving portion is not larger than a predetermined amount.

8. The image heating device according to claim 6, wherein the control portion stops the rotation of the driving rotating member when it is detected a predetermined number of times within a predetermined time that an amount of light received by the light receiving portion is not larger than a predetermined amount.

9. The image heating device according to claim 6, wherein the control portion stops the rotation of the driving rotating member when it is detected for a predetermined time that an amount of light received by the light receiving portion is not larger than a predetermined amount.

10. The image heating device according to claim 1, further comprising:

a heating mechanism configured to heat the belt; and a driving rotating member configured to form a nip in cooperation with the belt and to drive the belt, wherein the control portion controls, according to the output of the light receiving portion, whether to stop a heating operation of the heating mechanism and a rotation of the driving rotating member.

11. The image heating device according to claim 10, wherein the control portion stops the heating operation of the heating mechanism and the rotation of the driving rotating member when an amount of light received by the light receiving portion is not larger than a predetermined amount.

12. The image heating device according to claim 10, wherein the control portion stops the heating operation of the heating mechanism and the rotation of the driving rotating member when it is detected a predetermined number of times within a predetermined time that an amount of light received by the light receiving portion is not larger than a predetermined amount.

13. The image heating device according to claim 10, wherein the control portion stops the heating operation of the heating mechanism and the rotation of the driving rotating member when it is detected for a predetermined time that an amount of light received by the light receiving portion is not larger than a predetermined amount.

14. An image heating device comprising:

an endless belt configured to heat an image on a sheet at a nip in an image heating operation;

a driving rotatable member configured to rotationally drive the endless belt and to form the nip cooperatively with the endless belt therebetween;

a light emitter disposed at one end of the belt in a widthwise direction of the belt and configured to emit light from one end of the belt to the other end of the belt in a widthwise direction of the belt such that the light passes near an outer peripheral surface of the belt;

a light receiver disposed at the one end of the belt and configured to receive the light from the light emitter;

a light reflector disposed at the other end of the belt and configured to reflect the light from the light emitter to the light receiver; and a determining portion configured to determine, according to an output of the light receiver by receiving the light from the light emitter via the light reflector, whether breakage of the belt has occurred.

15. The image heating device according to claim 14, wherein, when a light amount received by the light receiver is not larger than predetermined light amount, the determining portion determines that the breakage of the belt has occurred, and wherein, when the light amount received by the light receiver is larger than the predetermined light amount, the determining portion determines that the breakage of the belt has not occurred.

16. The image heating device according to claim 15, wherein, when the determining portion determines that the breakage of the belt has occurred, the image heating operation is prohibited, and wherein, when the determining portion determines that the breakage of the belt has not occurred, the image heating operation is permitted.

* * * * *